United States Patent [19]

Miller et al.

[11] 4,062,211

[45] Dec. 13, 1977

[54] ROTARY PLUG CYLINDER LOCK

[76] Inventors: Harry C. Miller, 24 Seneca Ave., Rochester, N.Y. 14621; Herman Edward Tickel, Jr., 14818 Woodhome Road, Centreville, Va. 22020

[21] Appl. No.: 766,539

[22] Filed: Feb. 7, 1977

[51] Int. Cl.[2] ..... E05B 29/04; E05B 63/00

[52] U.S. Cl. ..... 70/366; 70/417; 70/419; 70/422

[58] Field of Search ..... 70/362, 365, 366, 376, 70/377, 416, 417, 419, 421, 422

[56] References Cited

U.S. PATENT DOCUMENTS

| | | | |
|---|---|---|---|
| 3,367,156 | 2/1968 | Johnstone | 70/366 |
| 3,587,261 | 6/1971 | Berry | 70/422 |
| 4,008,588 | 2/1977 | Miller | 70/366 |

*Primary Examiner*—Robert L. Wolfe

*Attorney, Agent, or Firm*—Mason, Fenwick & Lawrence

[57] ABSTRACT

A key operated rotary plug cylinder lock having rotary disk tumblers arranged in a pack within a rotary plug sleeve normally held against rotation within the lock casing by a locking bar which spans the shear line between the disk tumbler peripheries and the confronting wall of the rotary plug sleeve. True gates are provided in the tumblers to be aligned by an appropriate key with the locking bar to accommodate inward movement of the locking bar to a position releasing the plug for rotation within the casing, and shallower depth false gates are provided in each of the tumblers having associated false bottom recess portions in the front and rear walls of the tumblers providing forward and rearward false gate profiles or outlines simulating the profile of the true gate. Frangible tabs are also provided on each tumbler extending into a sector recess which will readily break upon excess torquing forces to prevent penetration of the lock by torquing tools.

9 Claims, 5 Drawing Figures

Fig-2
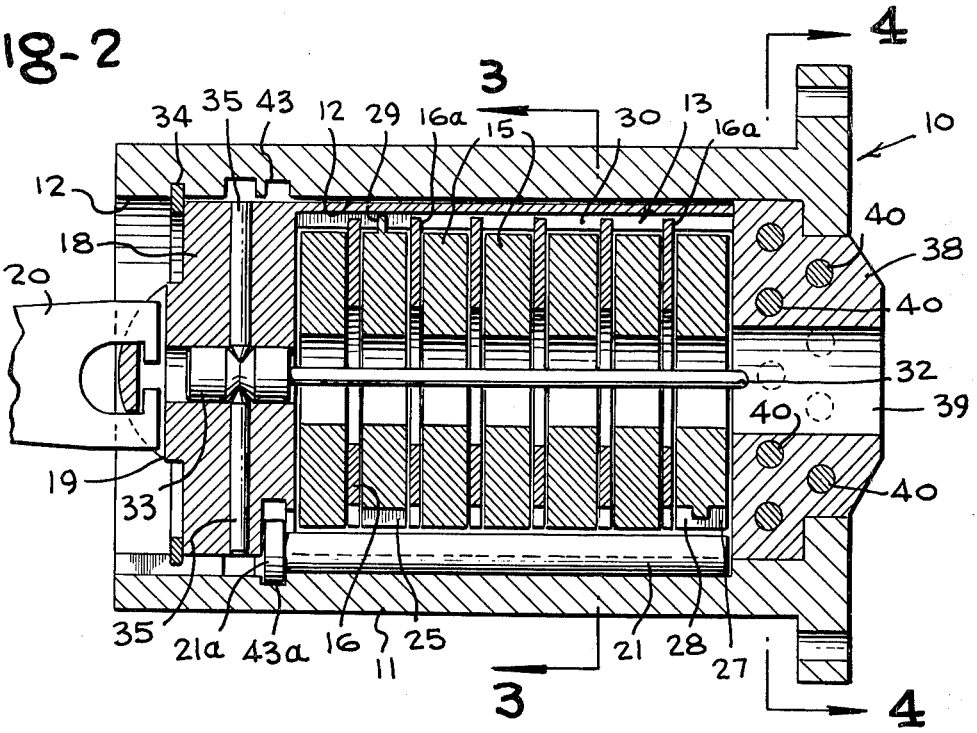
Fig-3
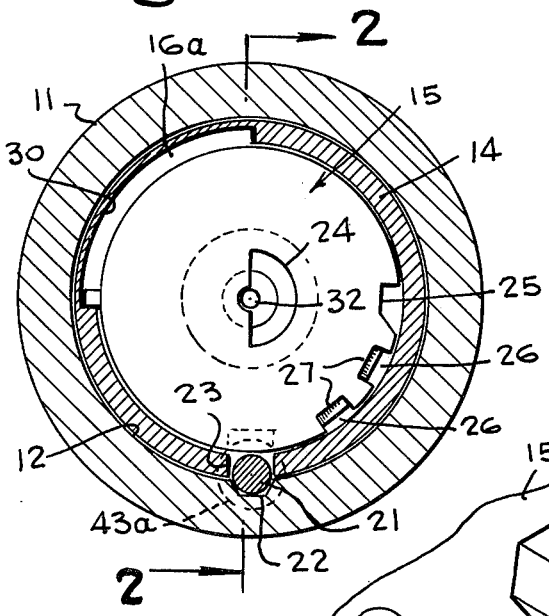
Fig-4
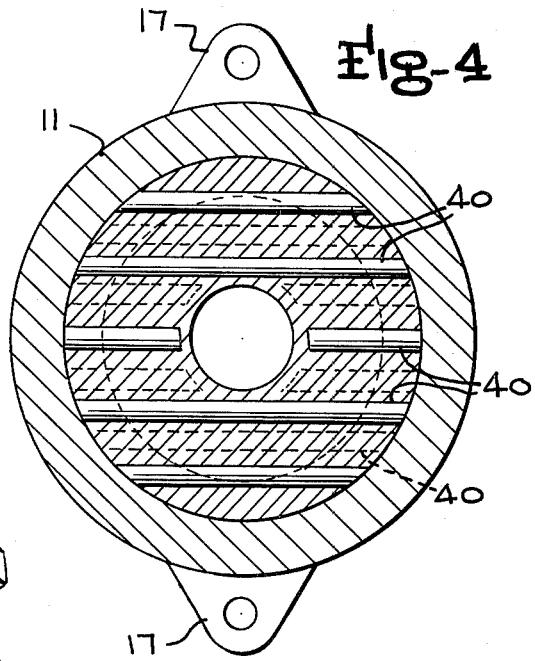
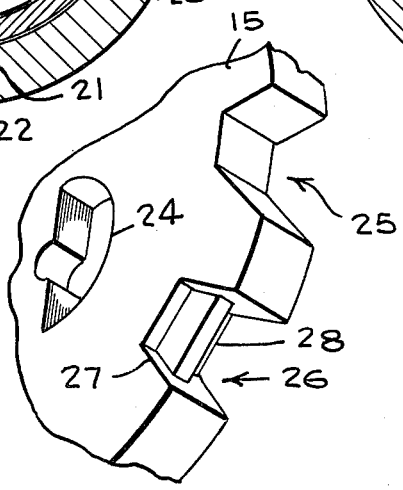
Fig-5

ROTARY PLUG CYLINDER LOCK

BACKGROUND AND OBJECTS OF THE INVENTION

The present invention relates in general to cylinder type key locks, and more particularly to key-operated rotary plug cylinder locks having rotary disk type tumblers incorporating special provisions to protect the lock against unauthorized operation by forcing of the lock with torquing tools and the like and constructed so as to resist detection of the combination or operation by picking probes or the like.

One of the common types of key locks which have come into wide use is the type known as a cylinder lock. Conventional cylinder locks normally comprise a relatively fixed cylinder forming the lock body or casing having a cylindrical bore opening through the front surface of the lock body which rotatably houses a rotating plug assembly. The rotating plug assembly has a keyway or key slot opening through the front surface of the plug and extending over most of the axial length of the plug, as well as one or more resiliently urged tumblers formed of rotatble or slidable members which normally occupy positions confronting or transversing shear planes or interfacial planes preventing rotation of the plug relative to the cylinder. When a key of proper contour or combination surface is inserted in the keyway or key opening in the plug, the contoured key surface aligns the resiliently urged tumbler members in such a way that a parting line, either of the tumbler members or of some other locking member coactive with the tumbler members, is brought into coincidence with the interfacial plane or the arcuate peripheral surface of the plug, so that when all of the resiliently urged tumblers are properly aligned by the contoured key surface, rotational motion imparted to the key permits the plug to turn through the normal motion involved in moving the lock from a locked to an unlocked condition.

Due to conditions which arise in the construction of the lock parts under normal manufacturing tolerances, it has been possible in cylinder locks which are not provided with special pick resistant features, to achieve unauthorized operation of the lock by such picking techniques as inserting a picking tool into the keyway and exerting a torque on the plug so that with careful movement of the plug in selected directions, the resiliently urged tumbler first placed in compression by torquing the plug is aligned by the pick for clearance, at which point the plug rotates a minute degree to bring the next resiliently urged tumbler into a similar compressed condition and is aligned by the pick for clearance, and this succession of operations is repeated until all of the tumblers have been aligned to permit the plug to be rotated.

One of the most common types of cylinder locks is the pin-tumbler type cylinder lock, wherein segmented tumbler pins formed of lower key-engaging pin segments and upper drive pin segments have a line of separation between the segments which is normally displaced from the shear line of the plug but is positioned by the proper key so that the line of separation of all of the pin tumblers align with the plug shear line and permit rotation of the plug. Such pin-tumbler type cylinder locks have been particularly susceptible to the above described types of picking techniques, and many attempts have been made to provide them with resistance to such picking operations.

To increase resistance to picking by the techniques which have been successfull with pin-tumbler type cylinder locks, cylinder locks of the rotary disk tumbler type have come into wider use. A popular type of rotary disk tumbler cylinder lock is one wherein a bank of peripherally gated rotary locking disks housed within a rotatable sleeve member have shaped center apertures which repsond to a proper key surface to align the gates to permit radially inward movement of a locking bar which normally traverses the shear line between the rotary sleeve and an outer fixed cylinder casing. Examples of rotary disk tumbler type cylinder locks of this type are found in U.S. Pat. Nos. 3,771,340, 3,621,689 and 3,848,442. Unauthorized detection of such rotary disk tumbler cylinder locks has been achieved, however, by techniques such as introducing a picking probe or similar tool into the key opening to interpose a radial extension of the shank of the probe between the faces of successive rotary disk tumblers and manipulating the probe to feel with the end of the radial extension the positions of the peripheral gates in the rotary disk tumblers which receive the locking bar to permit its movement to unlocking position. By observing the angular position of the probe externally of the lock at the positions at which the gates are felt, one can determine therefrom the key combination or shaped surface contour of the key for the lock. Also, introduction of a torquing tool into the plug of such locks to apply sufficient force to distort or jam relatively thinner components of the lock works into normally unoccupied spaces within the lock and force the locking bar into the slot therefor in the plug sleeve has resulted in unauthorized penetration of the lock.

An object of the present invention is the provision of a novel rotary plug cylinder lock having rotary disk type tumblers constructed to resist unauthorized detection of the key combination for the lock and resist unauthorized penetration of the lock by torquing techniques.

Another object of the present invention is the provision of rotary plug cylinder locks of the type described in the preceding paragraph, wherein disabling features are incorporated in the lock to prevent penetration or unauthorized operation of the lock when the plug is subjected to excessive stresses in certain directions.

Other objects, advantages and capabilities of the present invention will become apparent from the following detailed description, taken in conjunction with the accompanying drawings illustrating a preferred embodiment of the invention.

BRIEF DESCRIPTION OF THE FIGURES

FIG. 2 is a vertical longitudinal section view taken along the line 2—2 of FIG. 3;

FIG. 3 is a vertical transverse section view taken along the line 3—3 of FIG. 2;

FIG. 4 is a vertical transverse section view taken along the line 4—4 of FIG. 2; and FIG. 5 is a fragmentary perspective view of one of the rotary disk tumblers shown at enlarged scale.

DETAILED DESCRIPTION OF A PREFERRED EMBODIMENT

Figure 1:
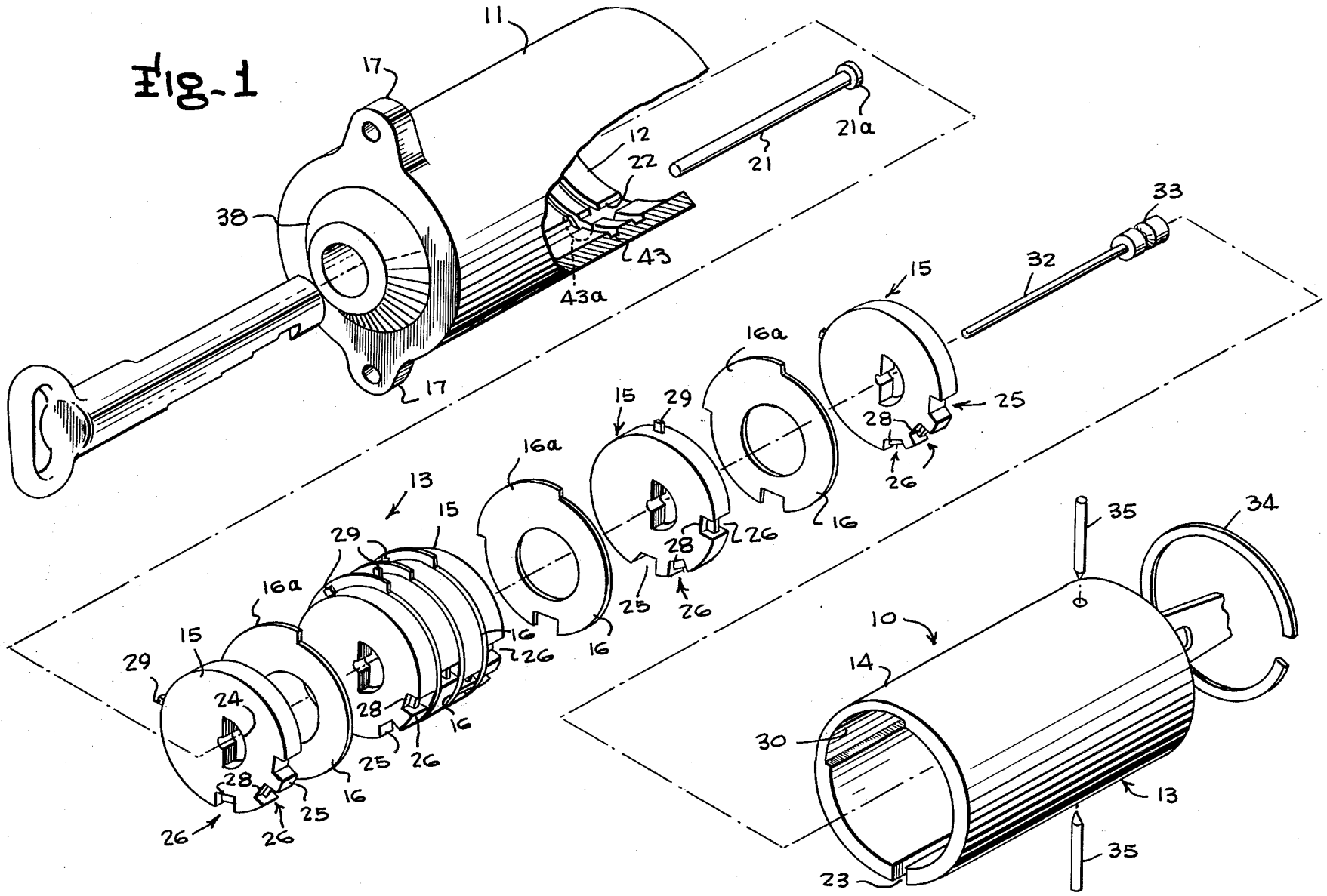
FIG. 1 is an exploded perspective view of a rotary plug cylinder lock embodying the present invention.

Referring to the drawings wherein like reference characters designate corresponding parts throughout the several figures, the cylinder lock of the present invention is indicated generally by the reference character 10 and comprises a generally cylindrical outer lock housing or casing 11 having a rearwardly opening cylindrical bore 12 housing a rotatable plug assembly 13. The rotatable plug assembly 13 includes a cylindrical outer plug sleeve or sheel 14 which encloses a stack of rotatable locking disks or tumbler disks 15 arranged in a stacked array concentric with the center axis of the plug sleeve or shell 14. Annular washers or spacers 16 are provided between successive tumbler disks in the illustrated embodiment, each of which may be provided with a radially outwardly projecting arcuate formation 16*a*, if desired, to extend into a sector groove, later described, on the inner surface of the outer plug shell 14 to limit or prevent rotation of the washers.

The cylinder casing 11 is provided with the usual mounting enlargements, such as those indicated at 17 in the drawings, having screw holes for mounting the lock casing on the door or other body supporting the lock assembly or may be provided with an enlarged cylindrical front flange and a suitable threaded mounting ring or clamping ring of conventional construction. The outer shell or sleeve 14 of the plug assembly has a cylindrical rear wall 18 sized to closely fit within the rearwardly opening bore 12 of the stationary cylindrical casing 11, and is provided with an integral boss or coupling formation 19 to which is coupled the usual connecting bar 20 connected to a conventional latch bolt or the like to be locked and unlocked by the cylinder lock plug when the latter is rotated from locked to unlocked position upon insertion of a proper key.

In the normal condition of the lock without the proper key being inserted, the outer sleeve 14 of the plug assembly 13 is fixed against rotation relative to the lock cylinder casing 11 by means of a locking bar 21 extending parallel to the axis of the plug assembly and positioned so that it is partially located in an axial groove 22 in the inwardly facing surface of the cylinder casing 11 and partially located in an axial slot 23 in the wall of the sleeve 14, so as to span the shear line between them. The rotary locking disks 15 in the described embodiment may have a semi-circular center opening 24 like the center openings in the locking disks of the earlier Oy Wartsila U.S. Pat. Nos. 3,621,689 or 3,385,677 or 3,681,956, to operate with one or more keys of semi-circular cross section cut in the accordance with a predetermined key coding to provide the combination surface of the key. Typically, the combination surfaces of such keys have combination values at various incremental step angles, with the angled combination surfaces of the key cut at stepped angles spaced 18° apart, for example, providing combination surfaces on the key of 10°, 18°, 36°, 54°, 72° or 90°. The peripheral portions of the locking disks 15 are provided with one or more outwardly opening gates or recesses 25 to be radially aligned with the axial slot 23, axial groove 22 and locking bar 21. Only when the appropriate key is inserted in the keyway defined by the center openings 24 and the key is rotated through an appropriate angle in the proper direction, is the plug sleeve 14 released as the tumbler gates 25 in the locking disks 15 are brought by the combination surface of the key into a position radially aligned with the locking bar. The aligned tumbler gates 25 in this position form a groove aligned with the locking bar 21 which receives the locking bar when a torque is transmitted to the plug sleeve 14 by turning of the key further in the same direction, and a side wall of the axial groove 22 is customarily shaped to facilitate camming of the locking bar radially inwardly when the tumbler gates are aligned to receive it.

Most of the locking disks 15 are rotatable between a zero position, shown in FIG. 2, in which the insertion and removal of the key is possible, and an angularly displaced position, called a release position, in which the tumbler gate 15 is lined up to receive the locking bar 21, or is movable to two angular displaced release positions and is provided with two tumbler gates so that there are two angular positions at which the tumbler gates are properly aligned to receive the locking bar. The location of the tumbler gates 25 in the locking disks 15 determines the combination value of each locking disk, and this is the angle the disk has to be turned from its zero position to its releasing position by the key. Typically, at least one of the locking disks 15 has a turning angle of zero degrees and is non-rotatably fixed to the plug sleeve 14 to transmit the torque from the key to the plug, and this tumbler disk has a tumbler gate 25 which is constantly in releasing position aligned with the locking bar 21. Customarily, the locking disks 15 also have one, two or more false peripheral gates 26, in addition to the tumbler gates 25, normally termed true tumbler gates, so that if the tumbler disks 15 are manipulated by conventional picks or combination detecting tools by unauthorized persons to produce clicks or detecting sounds when their peripheral gates become aligned individually with the locking bar, since the false gates upon alignment with the locking bar also produce similar sounds and therefore give a false sound indication of tumbler position. The false gates 26, as indicated in the drawings, are usually shallow gates having a depth only about half that of the true gates 25, and thus, if any false gates 26 of any of the locking disks 15 become aligned with the locking bar along with true gates 25 of the remaining disks, the amount of inward locking bar movement permitted by the shallower false gates 26 will not be adequate to completely displace the locking bar out of the shear plane and therefore the plug would not be released for rotation.

In rotary disk cylinder locks of this concentration, it has been possible for unauthorized persons to detect the combination by use of a specially shaped combination detecting probe which can be inserted into the keyway and has a radially extending probe portion projecting from the shank thereof which is inserted between an adjacent pair of the locking disks and has a slight projection on the outer end of the radial probe portion to engage the face of the locking disk and feel the location of the true gate therein. The detecting probe is designed to be rotated about the shank portion thereof inserted in the keyway and its radial portion has an appropriate length to position the gate-feeling projection in a circular path which intercepts the deepest portion of the true gate but lies radially inwardly of the bottoms of the falst gates. By rotating the probe with the gate-filling projection against the face of each of the locking disks in succession, feeling the engagement of the probe end portion with the tumbler gate, and noting the angular position of the probe externally of the lock, one can detect the combination or shaped surface contour of the key which will open that lock.

To avoid detection of the location of the true tumbler gates by this technique, the rotary tumbler disks of the present invention are additionally provided with forwardly and rearwardly opening wells or sculptured recesses, indicated at 27 and 28 in the drawings, which form, in effect, radially inwardly extending false bottom recess portions of the false gates 26 which extend through only about one-third of the axial depth of the associated disk member 15. The false bottom recess portions 27, 28, coact with the shallow depth false gates 26, to produce forwardly and rearwardly facing gate profiles which appear to have the same size and profile configuration as the true gate 25, and extend to the same radial depth as the true gate 25, so that the gate-feeling projection on the end of the radial probe portion of the special detecting probe would be intercepted by these false bottom recess portions of the false gates as well as by the true gates for each member scanned by the probe and thereby confuse the indication as to the location of the true gate for that tumbler disk.

Also, the fact that the rotary disk cylinder locks of the type disclosed in the prior Oy Wartsila patents had an outwardly projecting radial tab or protrusion on each tumbler disk which was of the same thickness and structural strength as the remainder of the tumbler disks and extended into a circumferentially elongated sector recess, for example, a 90° sector recess, in the inwardly facing wall of the plug, which recess usually extended entirely through the thickness of the wall of the plug, in conjunction with the nature of the construction of the remaining lock components, has permitted that type of lock to be forced open by using a torquing tool which can be inserted in the keyway of the pack of rotary disks and supply sufficient force to distort material into spaces in the lock and achieve forcing of the locking bar into the release position for unauthorized breaking of the lock. Such torquing penetration techniques are prevented in the present lock by forming the radially projecting tab or protrusion 29 on each locking disk 15 as a thin frangible tab which is of considerably smaller thickness, in a direction axially of the pack of locking disks, than the thickness of the main body of the associated locking disks. Thus, the thin frangible tab 29 will readily shear when forced against the end wall of the sector recess 30 in the plug sleeve 14 in which it normally lies if the locking disks are torqued with a force exceeding a preselected value before sufficient force can be applied to shear the locking bar or so distort the lock components as to achieve unauthorized penetration.

As a further measure to prevent unauthorized penetration of the lock, the lock may include a small diameter axially extending center pin member 32 concentric with the center axis of the keyway defined by the openings 24 in the stack of locking disks and extending forwardly through the full length of the keyway. The semi-circular cross section key to be used with the lock is, of course, appropriately recessed to accommodate this center pin member 32. The center pin member 32 includes an enlarged rear portion 33 positioned in a similarly sized opening extending through the rear wall 18 of the plug sleeve 14 and frictionally restrained therein so that it is removable rearwardly in the opening only when a predetermined rearward driving force is applied to the plug assembly, for example, by rearward driving forces against the stack of locking disks to drive the plug out of the casing. This technique has been previously used in an effort to overcome the usual O-ring 34 which is interfitted in an annular groove in the surface of the bore 12 adjacent the rear wall of the plug to normally hold the plug in its bore 12. The enlargement on the rear of the center pin member 32 serves as an actuating cam for one or more radial lockout pins 35 slidably supported and frictionally restrained in radial passages in the rear wall 18 of the plug sleeve and aligned with sockets at appropriate circumferentially spaced positions on the inwardly facing surface of the cylindrical wall of the casing 11 surrounding the bore 12, into which the outer ends of the lockout pins are driven by action of the cam surface formations on the center pin enlargement 31 when the center pin is driven rearwardly.

To protect the lock against unauthorized operation involving drilling through the front of the lock assembly into the bore 12, for example, to gain access to the locking disks, the front portion of the lock may be provided with an entrance collar such as that indicated at 38 in the drawings at the entrance to the keyway provided with means to resist drilling through the front of the lock assembly. In the illustrated embodiment, the entrance collar 38 is substantially coextensive with the cross section of the bore 12 and has an external flange interfitting in appropriately shaped portions of the front wall of the casing 11 to support the collar at the entrance to the keyway. The collar 38 is provided with a key entrance opening 39 of semi-circular cross section conforming to the cross section of the uncut shank of the key, and has a plurality of bores drilled therethrough along axes paralleling a diameter of the entrance collar 38 in which are tightly fitted drill resistant steel rods 40. The drill resistant steel rods 40 are located sufficiently close together to prevent passage of drill bits of the usual size therethrough which might be used in an attempt to illegally penetrate the lock, and thus form a grille-like array of drill resistant steel rods extending along chords paralleling a diameter of the collar to form drill resistant barriers along the paths one may attempt to advance a drill bit through the collar into the locking disk cavity and thereby divert or break the drill bit or resist its penetration into the cavity. If desired, the drill resistant steel rods may be formed in a lattice pattern spanning the collar along chords paralleling two relatively perpendicular diameters of the entrance collar, rather than merely disposing them along chords paralleling a single diameter of the collar. To prevent unauthorized forward removal of the locking bar 21 by drilling, an enlarged head **21*a* is formed integrally on the rear of the bar 21 and is seated in a deepened sector 43*a* of shallower annular groove 43 when the box 21 occupies the groove 22. The head 21*a* moves in the annular groove 43 upon rotation of the plug when the bar 21** is received in the true gate.

What is claimed is:

1. A cylinder lock of the rotatable disk tumbler type comprising a stationary cylinder casing, a rotatable plug assembly in said casing including an inner shell member rotatable in the casing and a plurality of locking disk tumblers encircled within said shell member and rotatable about a common axis therein, an elongated locking bar paralleling the axis of rotation of said disk tumblers adjacent the periphery thereof normally restrained by the disk tumblers at a position traversing the shear line between the inner shell member and the casing for locking the inner shell member against rotation relative to the casing, the disk tumblers being formed with substantially circular body portions having true gate recesses of appropriate depth alignable with and adapted to receive said locking bar to accommodate radial inward movmement of the locking bar relative to the disk tumblers to a position permitting rotation of the inner shell member relative to the casing and said tumblers having key openings therein collectively defining a forwardly opening keyway and shaped to be engaged and angularly moved by a key inserted therein for aligning the true gate recesses with the locking bar, said tumblers each having a tab formation projecting from the periphery of the circular portion thereof, said inner shell member having an inwardly opening, circumferentially elongated sector recess for receiving the tab formations projecting from each of the disk tumblers over a selected range of angular movement of the tumblers, the sector recess having an end wall defining stop surfaces for engaging the tabs and angularly positioning the tumblers to align their key openings at proper positions to receive a key therein, and the tab formation of each disk tumbler being a thin frangible member of less thickness than the circular body portion designed to be sheared from the thickness circular body portion of associated disk tumbler by engagement with end walls of the sector recess when torque forces exceeding a predetermined threshold value are applied to the tumblers.

2. A cylinder lock as defined in claim 1, wherein said locking bar has an enlongated rectilinear bar portion of uniform cross section spanning the plurality of disk tumblers and paralleling the common axis of rotation of the disk tumblers to be received in the true gates of the disk tumblers and having at the rear end integral therewith an enlarged head protruding radially in all directions beyond the bar portion, and said shell member having a socket receiving part of said head in nested relation therein defining a rearwardly facing stop shoulder adjacent the nested head portion preventing forward axial movement of the locking bar member, and the shell member having an annular groove aligned transversely with said head for accommodating a portion of the head during rotation of the plug assembly when the locking bar is nested in said true gates.

3. A cylinder lock as defined in claim 1, wherein said inner shell member includes a rear wall transversely spanning the shell having a pair of radial guide passages opening through the outer periphery thereof housing normally retracted elongated slidable lockout pins therein, said casing having sockets located to receive ends of said lockout pins when displaced outwardly from their retracted position, a center pin member extending from said rear wall forwardly through the length of the keyway having cam formations confronting said lockout pins for forcing the pins radially outwardly into said sockets when rearward driving forces exceeding a predetermined value are applied to the center pin members for locking the plug assembly against rearward dislodgement from the casing.

4. A cylinder lock as defined in claim 2, wherein said inner shell member includes a rear wall transversely spanning the shell having a pair of radial guide passages opening through the outer periphery thereof housing normally retracted elongated slidable lockout pins therein, said casing having sockets located to receive ends of said lockout pins when displaced outwardly from their retracted position, a center pin member extending from said rear wall forwardly through the length of the keyway having cam formations confronting said lockout pins for forcing the pins radially outwardly into said sockets when rearward driving forces exceeding a predetermined value are applied to the center pin members for locking the plug assembly against rearward dislodgement from the casing.

5. A cylinder lock as defined in claim 1, wherein the circular body portions of each of said tumblers include false gates in addition to the true gate recess spaced circumferentially from the latter and having a shallower depth radially of the tumbler than the true gate such that the locking bar when received into any of the false gates occupies a position maintaining the inner shell member locked against rotation relative to the casing, and the circular body portions of each disk tumbler having false bottom recess portions extending radially inwardly from said false gates to the same distance from said periphery as the true gate recesses to define at said false gates forwardly and rearwardly facing recesses extending only partially through the thickness of the body portion and opening through the front and rear surfaces of the disk tumbler having profiles at said surfaces substantially identical to the profiles of the true gate recesses.

6. A cylinder lock as defined in claim 5, wherein said locking bar has an enlongated rectilinear bar portion of uniform cross section spanning the plurality of disk tumblers and paralleling the common axis of rotation of the disk tumblers to be received in the true gates of the disk tumblers and having at the rear end integral therewith an enlarged head protruding radially in all directions beyond the bar portion, and said shell member having a socket receiving part of said head in nested relation therein defining a rearwardly facing stop shoulder adjacent the nested head portion preventing forward axial movement of the locking bar member, and the shell member having an annular groove aligned transversely with said head for accommodating a portion of the head during rotation of the plug assembly when the locking bar is nested in said true gates.

7. A cylinder lock as defined in claim 5, wherein said inner shell member includes a rear wall transversely spanning the shell having a pair of radial guide passages opening through the outer periphery thereof housing normally retracted elongated slidable lockout pins therein, said casing having sockets located to receive ends of said lockout pins when displaced outwardly from their retracted position, a center pin member extending from said rear wall forwardly through the length of the keyway having cam formations confronting said lockout pins for forcing the pins radially outwardly into said sockets when rearward driving forces exceeding a predetermined value are applied to the center pin members for locking the plug assembly against rearward dislodgement from the casing.

8. A cylinder lock as defined in claim 1, wherein said stationary cylinder casing includes a rotatable front entrance collar substantially coextensive with the cross section of said rotatable plug assembly having a keyway aligned with the keyway defined by the key openings in the plurality of disk tumblers for insertion of the key therethrough into the disk tumbler key openings, and said collar having a plurality of elongated drill diverting hardened metallic rods extending along parallel axes paralleling at least one diameter of the collar member along chords of the circular cross section of the collar member and transversely spanning the collar member to resist drilling through the collar into the zone occupied by the locking disk tumblers.

9. A cylinder lock as defined in claim 8, wherein the circular body portions of each of said tumblers include false gates in addition to the true gate recess spaced circumferentially from the latter and having a shallower depth radially of the tumbler than the true gate such that the locking bar when received into any of the false gates occupies a position maintaining the inner shell member locked against rotation relative to the casing, and the circular body portions of each disk tumbler having false bottom recess portions extending radially inwardly from said false gates to the same distance from said periphery as the true gate recesses to define at said false gates forwardly and rearwardly facing recesses extending only partially through the thickness of the body portion and opening through the front and rear surfaces of the disk tumbler having profiles at said surfaces substantially identical to the profiles of the true gate recesses.

* * * * *